US009033736B2

(12) United States Patent
Like et al.

(10) Patent No.: US 9,033,736 B2
(45) Date of Patent: May 19, 2015

(54) ELECTRICAL CONNECTOR WITH MAXIMIZED CIRCUIT-TO-CIRCUIT ISOLATION DISTANCE

(71) Applicants: Nathan Like, Farmington Hills, MI (US); David Demaratos, Farmington Hills, MI (US)

(72) Inventors: Nathan Like, Farmington Hills, MI (US); David Demaratos, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 107 days.

(21) Appl. No.: 13/888,575

(22) Filed: May 7, 2013

(65) Prior Publication Data

US 2014/0335720 A1 Nov. 13, 2014

(51) Int. Cl.

| | |
|---|---|
| ***H01R 13/40*** | (2006.01) |
| ***H01R 13/645*** | (2006.01) |
| ***H01R 43/26*** | (2006.01) |

(52) U.S. Cl.

CPC ..... *H01R 13/645* (2013.01); *H01R 43/26* (2013.01)

(58) Field of Classification Search

USPC ..... 439/595, 752

See application file for complete search history.

(56) References Cited

U.S. PATENT DOCUMENTS

| | | | | |
|---|---|---|---|---|
| 4,387,950 | A * | 6/1983 | Guzik et al. | 439/686 |
| 4,992,063 | A * | 2/1991 | Stein, Sr. | 439/752 |
| 5,595,509 | A * | 1/1997 | Fry et al. | 439/752 |
| 6,062,906 | A * | 5/2000 | Tanaka | 439/595 |
| 6,261,131 | B1 | 7/2001 | Kuroda et al. | |
| 6,280,206 | B1 | 8/2001 | Kuroda et al. | |
| 6,524,133 | B2 * | 2/2003 | Murakami | 439/595 |
| 6,648,697 | B2 * | 11/2003 | Yang | 439/701 |
| 6,672,885 | B2 | 1/2004 | Kuroda et al. | |
| 7,347,745 | B1 * | 3/2008 | Raudenbush et al. | 439/752 |
| 7,387,545 | B2 * | 6/2008 | Tyler et al. | 439/752 |
| 7,867,028 | B2 * | 1/2011 | Brown | 439/595 |
| 8,262,410 | B2 * | 9/2012 | Campbell et al. | 439/595 |
| 2006/0035536 | A1 * | 2/2006 | Sai | 439/752 |
| 2009/0247011 | A1 * | 10/2009 | Myer et al. | 439/595 |
| 2011/0143588 | A1 * | 6/2011 | Chikusa | 439/595 |

* cited by examiner

*Primary Examiner* — Gary Paumen

(74) *Attorney, Agent, or Firm* — Kratz, Quintos & Hanson, LLP

(57) ABSTRACT

An electrical connector having a male connector assembly of an insulating material for housing a plurality of pin contacts, and a female connector assembly of an insulating material, for housing a plurality of socket contacts for mating with the pin contacts. A circuit-to-circuit isolation distance is at least twice a connector mating distance, when the male and female connector assemblies are mated. A terminal position assurance cap, insertable from an end of the female connector assembly opposite an insertion face for the male connector assembly enables a maximized circuit-to-circuit isolation distance. The terminal position assurance cap assures that the socket contact is retained in the socket contact chamber, by blocking a flexible integral retention clip against the socket contact. The connector further includes an arrangement for removing the socket contact from the female connector assembly.

12 Claims, 18 Drawing Sheets

ELECTRICAL CONNECTOR WITH MAXIMIZED CIRCUIT-TO-CIRCUIT ISOLATION DISTANCE

BACKGROUND OF THE INVENTION

1. Field of the Invention

The present invention relates to an electrical connector for connecting multiple electrical circuits. The configuration of a male connector assembly and a female connector assembly of the electrical connector provides a maximized circuit-to-circuit isolation distance in relation to a connector mating distance of the male and female connector assemblies. A configuration of a terminal position assurance component, that assures socket contacts are locked in the female connector assembly, allows for the maximized circuit-to-circuit isolation distance. Additionally, a configuration of an integral retention clip for retaining a socket contact in the female connector assembly, allows removal of the socket contact in a novel manner.

2. Discussion of the Relevant Art

U.S. Pat. Nos. 6,672,885, 6,280,206 and 6,261,131 are directed to electrical connectors mounted to printed circuit boards, as in one embodiment of the electrical connector of the present invention. However, they are not directed to use in the automotive industry. Electrical connectors of the indicated patents lack features that are desirable to insure certain requirements for performance in the automotive industry. An important desired feature is a maximized circuit-to-circuit isolation distance in relation to the connector mating distance of the male connector assembly and the female connector assembly. The electrical connectors of the indicated patents do not provide an acceptable circuit-to-circuit isolation distance and do not provide an assurance of the socket contact being locked in the female connector assembly, as required for use in the automotive industry.

SUMMARY OF THE INVENTION

The present invention is an electrical connector, having a male connector assembly of an insulating material for housing a plurality of pin contacts, each pin contact being disposed in an individual chamber having solid sidewalls and an opening at an insertion face thereof, and a female connector assembly of an insulating material for housing a plurality of socket contacts for mating with the pin contacts, each socket contact being disposed in a tower element having solid sidewalls and an opening at an insertion face thereof, a terminal position assurance cap for assuring a position of each housed socket contact in the female connector assembly, the terminal position assurance cap having fingers insertable into the female connector assembly from a socket contact insertion end arranged opposite the insertion face, wherein a circuit-to-circuit isolation distance of the electrical connector is at least twice a connector mating distance, when the male and female connector assemblies are mated to have the tower elements fully inserted in the individual chambers.

In the electrical connector each tower element includes a socket contact chamber for housing the socket contact and a finger chamber adjoining and communicating with the socket contact chamber, the socket contact chamber being configured to have the socket contact insertable through the socket contact insertion end of the female connector assembly.

In the electrical connector each finger chamber includes a flexible integral retention clip for retaining the socket contact therein, the flexible integral retention clip being attached to the female connector assembly at the insertion face end thereof, and the fingers of the terminal position assurance cap assures the retaining of the socket contact in the socket contact chamber, by blocking the flexible integral retention clip against the socket contact.

In the electrical connector the plurality of fingers of the terminal position assurance cap are disposed on a base, the base having openings for passing the socket contacts, and the fingers and openings correspond to the finger chambers and the socket contact chambers of the tower elements, respectively.

In the electrical connector the terminal position assurance cap and the female connector assembly include: first locking means for holding the terminal position assurance cap at a partially inserted pre-blocking state for inserting the socket contacts into the socket contact chambers, and second locking means for holding the terminal position assurance cap at the fully inserted state.

In the electrical connector the male connector assembly and the female connector assembly include locking means for locking the same together.

In the electrical connector the male connector assembly includes a locking protrusion and the female connector assembly includes a flexible protrusion for bearing on the locking protrusion for locking the male connector assembly and the female connector assembly together when fully mated.

The electrical connector further has a connector position assurance component for insertion into the female connector assembly, wherein the connector position assurance component bears against the flexible protrusion to prevent flexing thereof.

The electrical connector further has a male connector assembly of an insulating material, for housing a plurality of pin contacts, each pin contact being disposed in an individual chamber having solid sidewalls and an opening at an insertion face thereof, and a female connector assembly of an insulating material, for housing a plurality of socket contacts for mating with the pin contacts, each socket contact being disposed in a tower element having an opening at an insertion face thereof, wherein each tower element includes in one sidewall a flexible integral retention clip for retaining the socket contact therein, and each tower element includes a service opening, in a sidewall opposing the flexible integral retention clip, for inserting a servicing tool to contact the flexible integral retention clip, to release the socket contact.

In the electrical connector each socket contact includes an access opening through which the servicing tool can access the flexible integral retention clip.

Another embodiment of the present invention is an electrical connector having a male connector assembly of an insulating material for housing a plurality of pin contacts, each pin contact being disposed in an individual chamber having solid sidewalls and an opening at an insertion face thereof, and a female connector assembly of an insulating material for housing a plurality of socket contacts for mating with the pin contacts, each socket contact being disposed in a tower element having an opening at an insertion face thereof, wherein each tower element includes in one sidewall a flexible internal retention clip for retaining the socket contact therein, and each tower element includes a service opening, in a sidewall opposing the flexible integral retention clip, for inserting a servicing tool to contact the flexible integral retention clip, to release the socket contact; and a terminal position assurance cap for assuring a position of each housed socket contact in the female connector assembly, the terminal position assurance cap having fingers insertable into the female connector assembly from a socket contact insertion end arranged opposite the insertion face.

The present invention includes a method for removing a socket contact from a female connector assembly of an insulating material, housing a plurality of socket contacts for mating with a pin contact of a male connector assembly, each socket contact being disposed in a tower element, each tower element including a socket contact chamber for housing the socket contact and a finger chamber adjoining and communicating with the socket contact chamber, each finger chamber of each tower element including in one sidewall a flexible integral retention clip for retaining the socket contact therein, and each tower element including a service opening, in a sidewall opposing the flexible integral retention clip; and inserting a servicing tool through the service opening to contact and flex the flexible integral retention clip to release the socket contact.

DETAILED DESCRIPTION OF THE PREFERRED EMBODIMENTS

Figure 1:
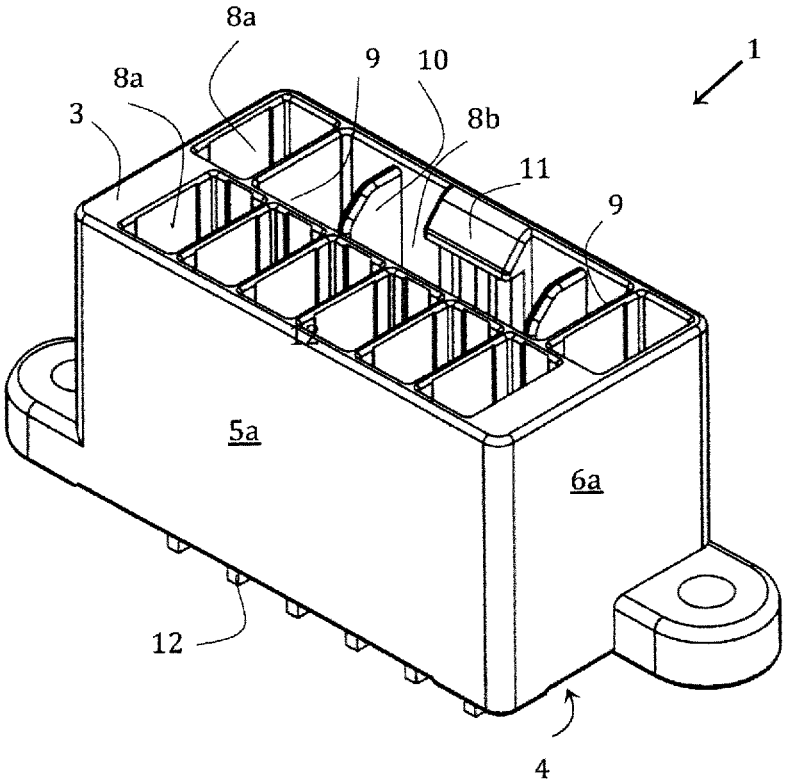
FIG. 1 is a perspective view of a male connector assembly of the electrical connector of the invention.
Figure 2:
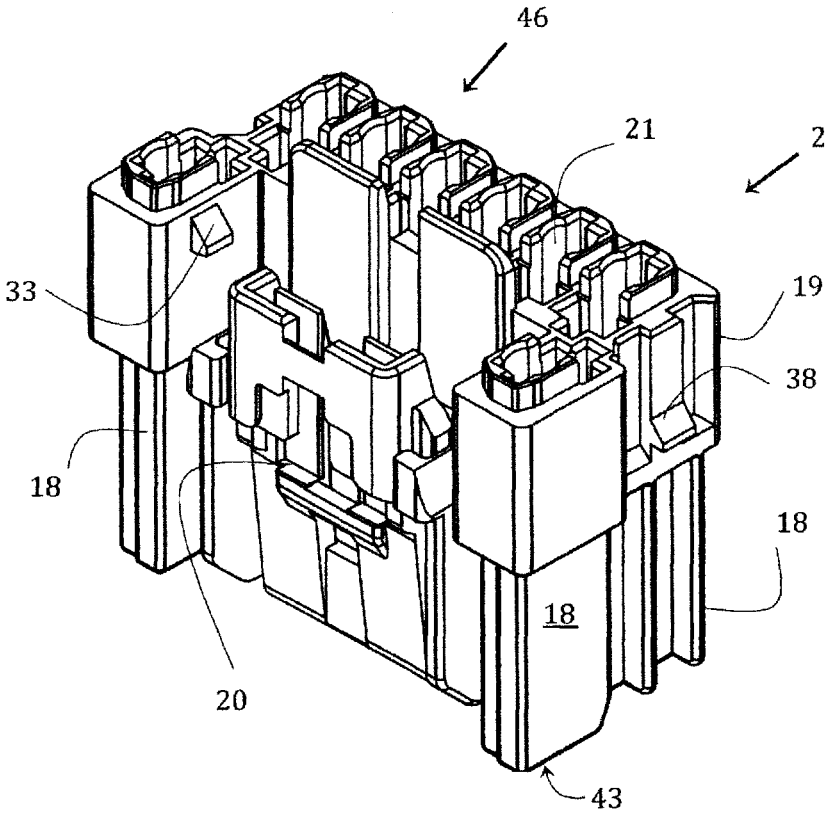
FIG. 2 is a perspective view of a female connector assembly of the electrical connector of the invention.

An electrical connector of the present invention includes a male connector assembly 1, shown in a perspective view in FIG. 1, and a female connector assembly 2, shown in a perspective view in FIG. 2. The male/female connotation is in relation to pin contacts disposed in the male connector assembly and socket contacts disposed in the female connector assembly, the pin contacts and socket contacts are discussed below.

As mentioned above, a feature of the present electrical connector is the excellent circuit-to-circuit isolation distance provided. In the following disclosure of the present invention the term circuit is in relation to the plurality of circuits that are being electrically connected by the connector. For example, each circuit is electrically connected by a conducting wire that terminates in a socket contact that is applied to an end of the conducting wire and disposed in the female connector assembly. Each circuit is then continued by contact of the socket contact with a pin contact that is disposed in the male connector assembly. The circuit is typically further connected through the male connector to a printed circuit board or another conducting wire to continue the circuit. Throughout the disclosure of the present invention, an electrical connector for mounting to a printed circuit board is shown as an example of the invention. However, it is to be understood that the inventive concepts can be incorporated into electrical connectors of various types, such as a wire to wire connector or any other type connector for connecting electrical circuits. It is also to be understood that the components of the electrical connector are formed of a suitable insulating material for the circuits being conducted.

The configuration of the male connector assembly is described with use of the various views found in FIGS. 1, 3, 4 and 5. It has, in general, a hexahedron shape with an insertion face 3 opposing a base 4, side walls 5*a* and 5*b*, and end walls 6*a* and 6*b*. The side walls 5*a* and 5*b*, end walls 6*a* and 6*b*, and a chamber bottom wall 7 form a cavity which is partitioned in a manner to form individual chambers 8*a* and 8*b*. Partitions 9, forming the individual chambers 8*a* and 8*b*, extend from a top surface of the chamber bottom wall 7 to a plane of the insertion face 3, with some partitions extending parallel to the side walls 5*a* and 5*b*, and other partitions extending parallel to the end walls 6*a* and 6*b*, in order to form the plurality of individual chambers 8*a* and 8*b*. The partitions are solid without any openings therein. The chamber 8*b* is provided with guide ridges 10, for facilitating mating of the male and female connector assemblies, and a latch means 11 for locking the male and female assemblies together, when mated.

The plurality of individual chambers 8*a* (eight are shown in FIG. 1) are preferably all of the same dimensions and each individual chamber houses a pin contact 12 which mates with a socket contact 13 of the female connector assembly, which is described below. Each pin contact 12, formed of a metal having good conductivity such as copper, penetrates the chamber bottom wall 7 of the male connector assembly and extends beyond the chamber bottom wall 7 for use in connecting to circuits of the printed circuit board on which it is mounted. Also extending from the chamber bottom wall 7 are positioning tabs 15 for precisely positioning the male connector assembly on the printed circuit board on which it is mounted. Line 16 in FIG. 4 denotes a top plane of a printed circuit board, however, the printed circuit board is not shown. A primary concern for the electrical connector is the circuit-to-circuit isolation distance and all possible paths between the pins must be considered. The following considerations are taken. A lower end of each of the pin contacts 12 extends below the top plane 16 of the printed circuit board, however, a central portion of each of the pin contacts is disposed in a cavity 17 that is present between the top plane of the printed circuit board and the bottom surface 14 of the chamber bottom wall 7. In order to isolate the plurality of pin contacts extending through cavity 17, a sealing material, such as silicon or rubber, is injected into the cavity after the male connector assembly is mounted on the printed circuit board. In another embodiment for connecting to circuits of a printed circuit board, a pre-molded silicon or rubber insert is placed into cavity 17 prior to mounting the male connector assembly to the printed circuit board. The sealing material conforms to the cavity 17 and the top plane of the printed circuit board in order to provide isolation of the pin contacts at their central portion extending from the bottom surface 14 of the chamber bottom wall 7 down to electrical contacts of the printed circuit board. If tips of the pin contacts extend past a bottom plane of the printed circuit board (not shown), a conforming coating of an insulating material is applied to the protruding tips of the pin contacts to prevent electrical shorting between the protruding tips. The above described connector for mounting to a printed circuit board is solely one use for the connector of the invention. Another important use would be for connecting a plurality of wires to other wires in order to further conduct the circuits being carried in the plurality of wires.

Figure 7:
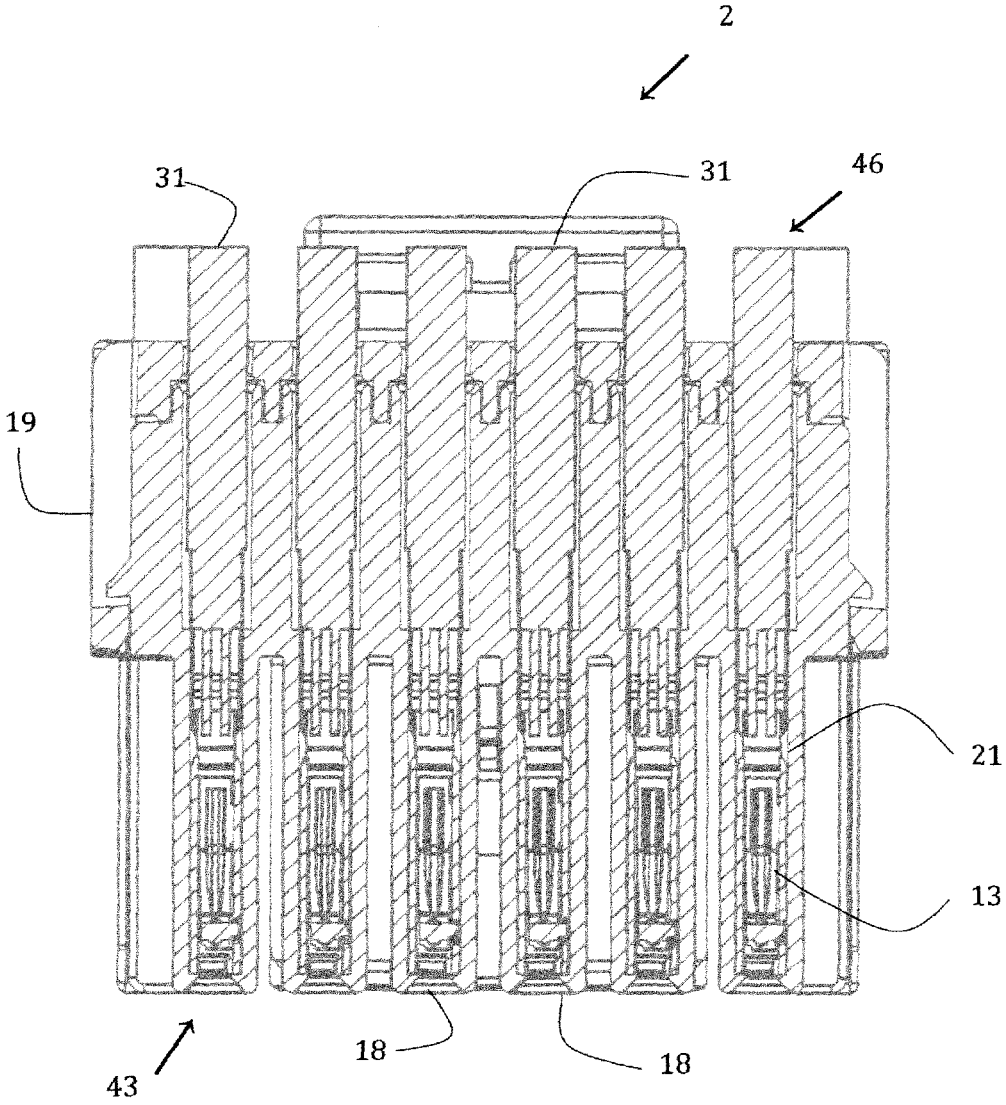
FIG. 7 is a cross-section view taken along line 7-7 in FIG. 6.

The configuration of the female connector assembly 2 is described with use of the various views found in FIGS. 2, 2A, 6, 7, 8A, 8B and 8C. The female connector assembly is made up of a plurality of individual tower elements 18. The plurality of individual tower elements are arranged to correspond to the arrangement of the individual chambers 8*a* of the male connector assembly and they are held in that arrangement by header 19 disposed near the top ends of the tower elements. The tower elements have an outer wall shape that corresponds to inner walls of the individual chambers 8*a* of the male connector assembly. The outer walls in a first embodiment are solid without any openings therein. The header 19 also supports a locking third latch 20, discussed below, for use in locking the male connector assembly to the female connector assembly 2, when mated. Referring to FIG. 7, each of the tower elements 18 has a socket contact chamber 21, extending the length of the tower element, for accommodating one socket contact 13. Each socket contact is applied to a conducting wire that is to be electrically connected to one of a device, a terminal, a power source, contacts on a printed circuit board, etc. Each socket contact is inserted into the socket contact chamber through socket contact insertion end 46.

As mentioned above, the female connector assembly may be connected to a male connector assembly mounted to a printed circuit board. However, a female connector assembly as presently being described can be used with a male connector assembly configured for purposes other than mounting to a printed circuit board.

Figure 8A:
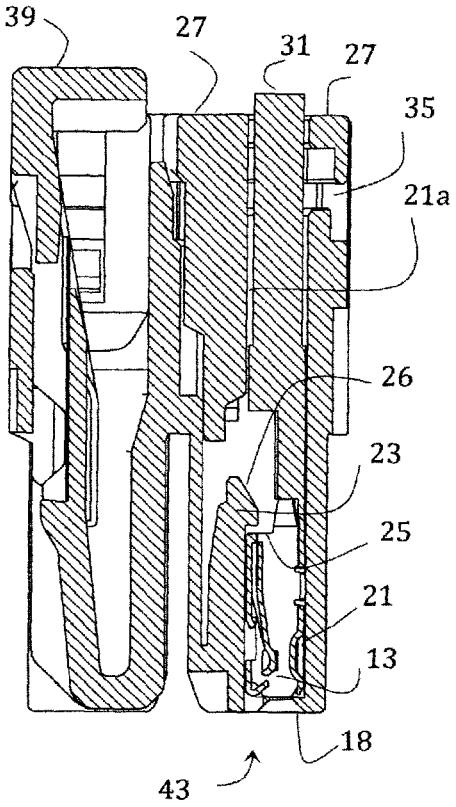
FIGS. 8A and 8B are cross-section views taken along line 8-8 in FIG. 6.
Figure 8B:
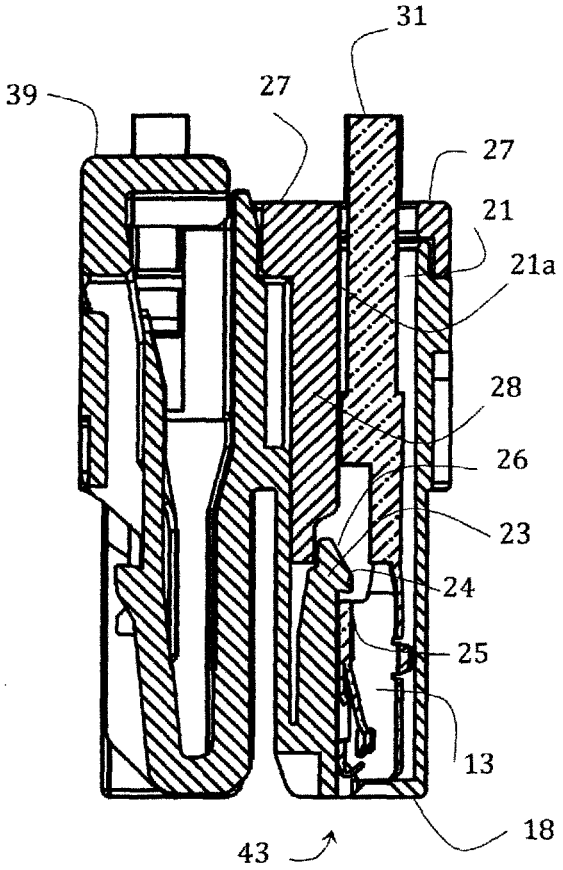
Figure 8C:
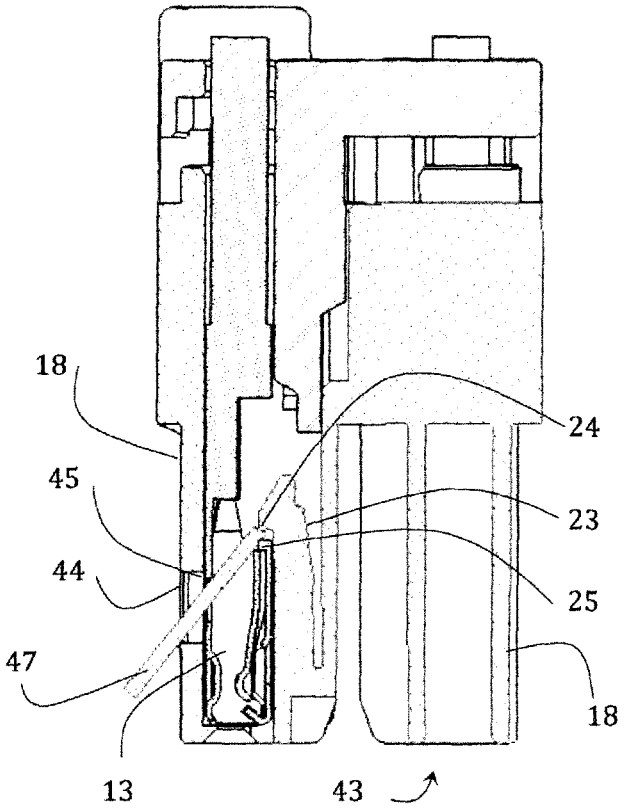
FIG. 8C is a cross-section view of the female connector assembly of FIG. 2A, for showing the use of a servicing tool.

Each of the tower elements 18 includes the socket contact chamber 21 and a finger chamber 21*a*. The socket contact chamber and finger chamber adjoin and communicate with each other, as best shown in FIGS. 8A, 8B and 8C. A flexible integral retention clip 23, disposed in the finger chamber 21*a*, retains the socket contact 13 in the socket contact chamber. As best shown in FIGS. 8A and 8B, a shelf 24 on the flexible integral retention clip 23 prevents the socket contact 13 from coming out of the socket contact chamber by engaging a top portion 25 of the socket contact. Because of the flexibility of the integral retention clip 23, the socket contact can pass by the integral retaining clip 23 when inserting the socket contact, as an end of the socket contact causes the flexible integral retention clip to move aside when contacting slanted surface 26. The integral retention clip 23 is connected to the female connector assembly 2 at an end opposite to the end into which the socket contact 13 is inserted, that is opposite to socket contact insertion end 46, and the flexible end of the integral retention clip is directed toward the socket contact insertion end. This arrangement makes possible the location of a terminal position assurance cap, discussed below, and makes possible the excellent circuit-to-circuit isolation distance of the connector.

Figure 9:
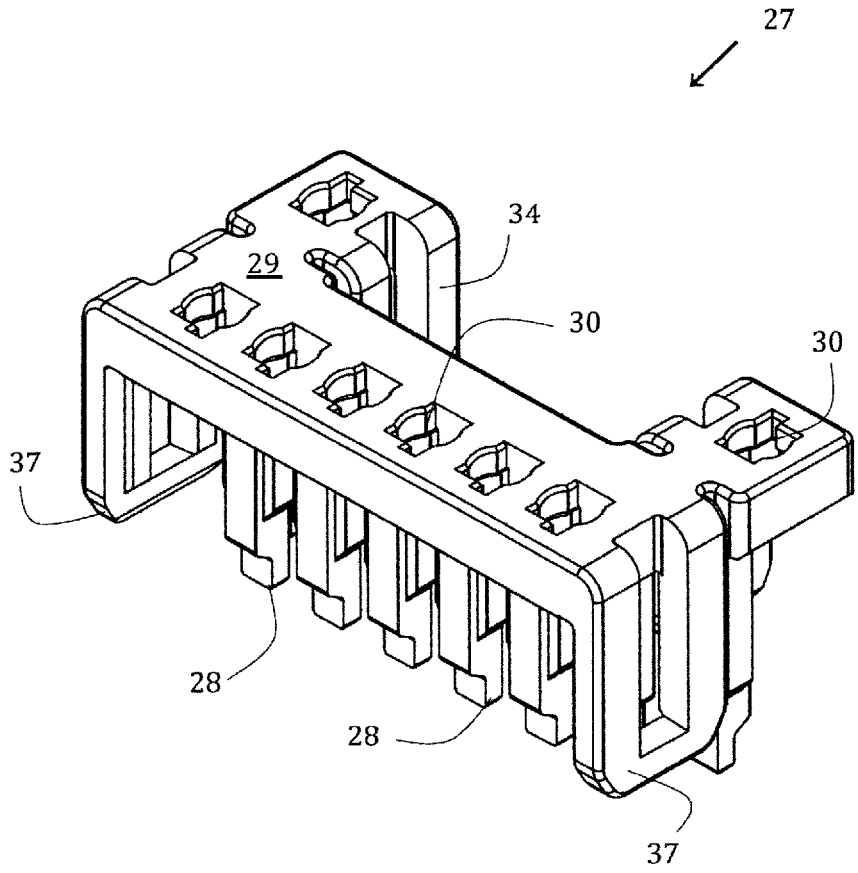
FIG. 9 is a perspective view of the terminal position assurance cap of the electrical connector of the invention.

Another important component of the electrical connector of the present invention is a terminal position assurance cap 27, shown in perspective view in FIG. 9. The purpose of the terminal position assurance cap is to provide a block against flexing of the integral retention clips 23. The terminal position assurance cap includes a plurality of fingers 28 arranged to correspond to finger chambers 21*a* which adjoin and communicate with the socket contact chambers 21 of the female connector assembly 2. The fingers, arranged to correspond to the finger chambers, are held in this arrangement by base 29. The base includes openings 30 that are arranged to correspond to ends of the socket contact chambers 21 of the female connector assembly 2.

The terminal position assurance cap is inserted in the same direction as the socket contacts, that is socket contact insertion end 46, and when fully in place the terminal position assurance cap has its base 29 disposed against the header 19 of the female connector assembly. However, the terminal position assurance cap is configured to be disposed at a pre-blocking position, described below, prior to it being fully inserted in place. If a socket contact is not fully seated in the female connector assembly, the terminal position assurance cap is prevented from going from the pre-blocking position to that in which the terminal position assurance cap has its base 29 disposed against the header 19 of the female connector assembly.

Wiring of the female connector assembly is carried out as follows. In a first step, the socket contacts 13 are attached to conducting wires 31 by crimping or soldering. The conducting wires are typically insulated and the insulation is stripped from an end portion thereof prior to crimping or soldering.

In a second step, fingers 28 of the terminal position assurance cap 27 are inserted into the finger chambers 21*a* of the female connector assembly 2 to a pre-blocking stage at which first locks, consisting of first protrusions 33 on the female connector assembly, and first latches 34 on the terminal position assurance cap 27 initially engage. As mentioned above, the terminal position assurance cap is inserted through the same end of the female connector assembly that the socket contacts 13 are inserted through, that is socket contact insertion end 46. At this stage, as shown in FIG. 8A, the fingers 28 are only partially inserted into the finger chambers 21*a*, and a gap exists between the header 19 and the base 29. This gap is indicated as 35 in FIG. 8A. In the partially inserted pre-blocking stage, shown in FIG. 8A, the integral retention clip 23 is free to flex as the socket contact 13 is inserted into the socket contact chamber.

A third step in the wiring of the female contact assembly is to insert each socket contacts 13, attached to the end of conducting wire 31, through opening 30 in the base of the terminal position assurance cap 27, then into socket contact chamber 21, as shown in FIG. 8A. As described above, the integral retention clip 23 is still free to flex in order to allow entry of each socket contact, and then flex back to its unflexed position in order to block removal of the socket contact.

Figure 12:
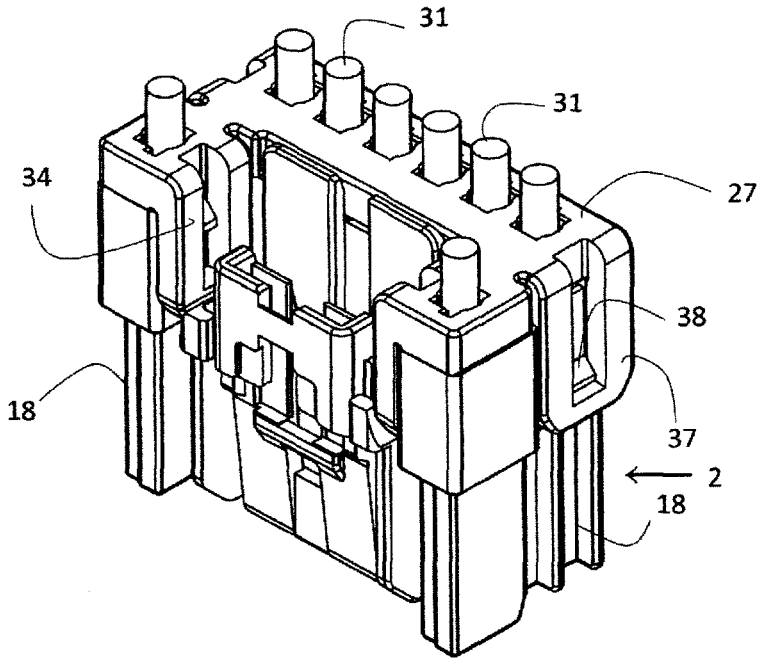
FIG. 12 is a perspective view of the terminal position assurance cap of the invention in place and the connector position assurance device partially inserted.
Figure 13:
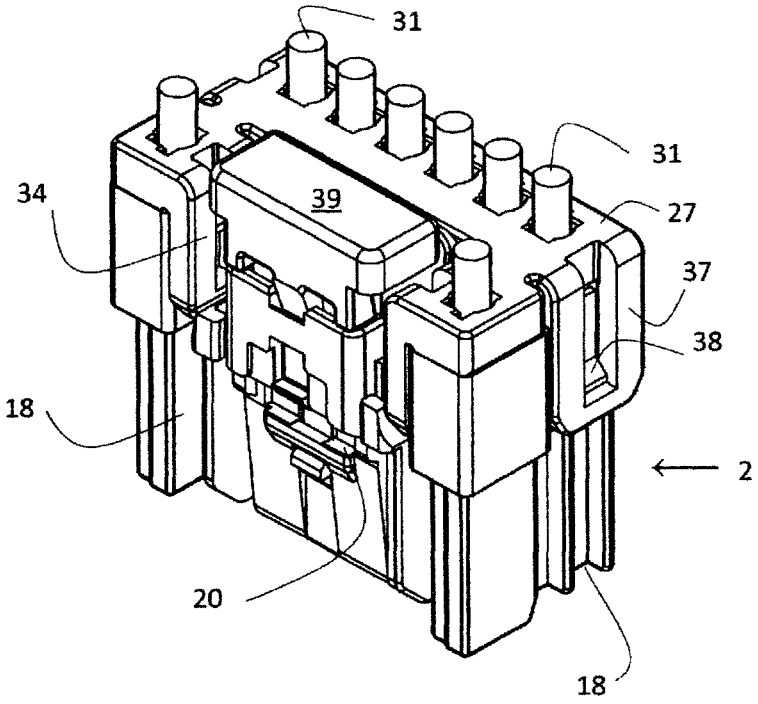
FIG. 13 is a perspective view of the terminal position assurance cap of the invention in place and the connector position assurance device fully inserted.

A fourth step in the wiring of the female contact assembly is to insert the terminal position assurance cap 27 fully, to a position where the base 29 contacts the header 19, and second locks engage. The second locks consist of second latches 37, on the terminal position assurance cap and second protrusions 38 on the female connector assembly, as shown in FIGS. 9 and 2, respectively. When the terminal position assurance cap is fully inserted, fingers 28 block integral retention clips 23, as shown in FIG. 8B, assuring that the socket contacts do not inadvertently come out of the female connector assembly. The terminal position assurance cap fully in place on the female connector assembly is shown in perspective in FIG. 12. If a socket contact 13 is not fully seated in the female connector assembly, the integral retention clip 23 will prevent the corresponding finger 28 from entering the finger chamber 21*a*.

Following the wiring of the female connector assembly, the male and female connector assemblies can be mated.

Figure 2A:
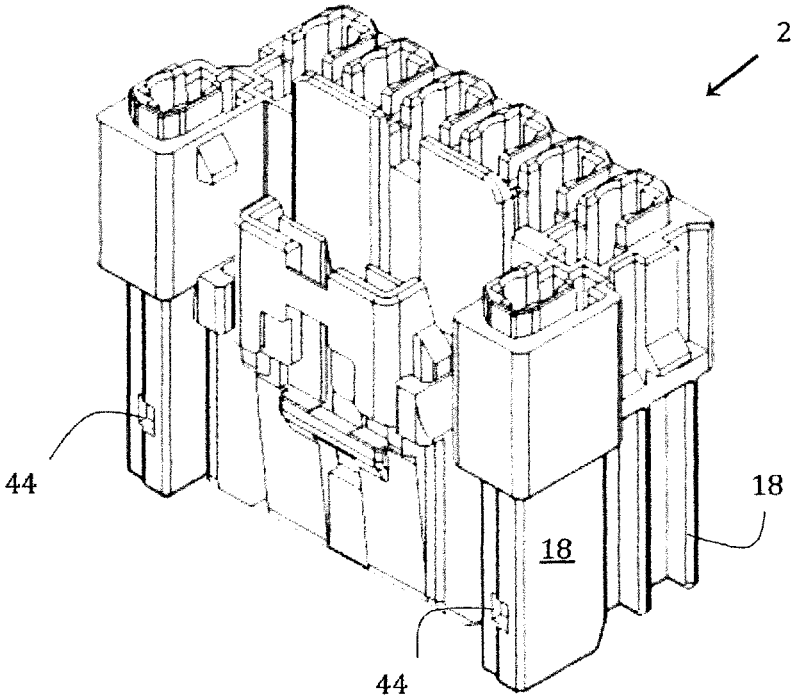
FIG. 2*a* is a perspective view of another embodiment of a female connector assembly of the electrical connector of the invention, having service openings.
Figure 3:
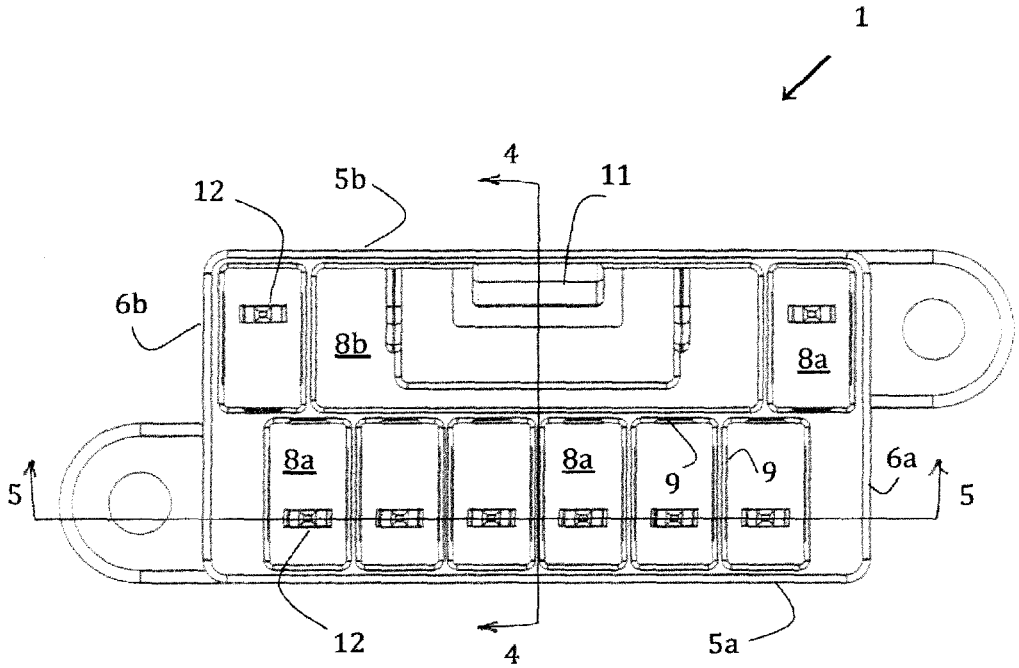
FIG. 3 is a view of an insertion face of the male connector assembly of FIG. 1.
Figure 4:
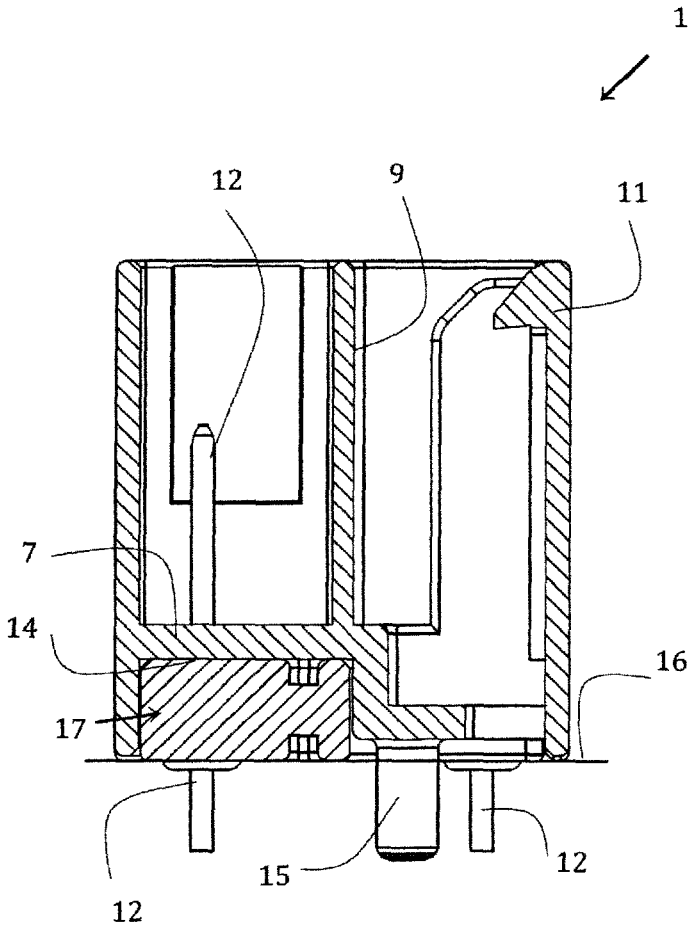
FIG. 4 is a cross-section view taken along line 4-4 in FIG. 3.
Figure 5:
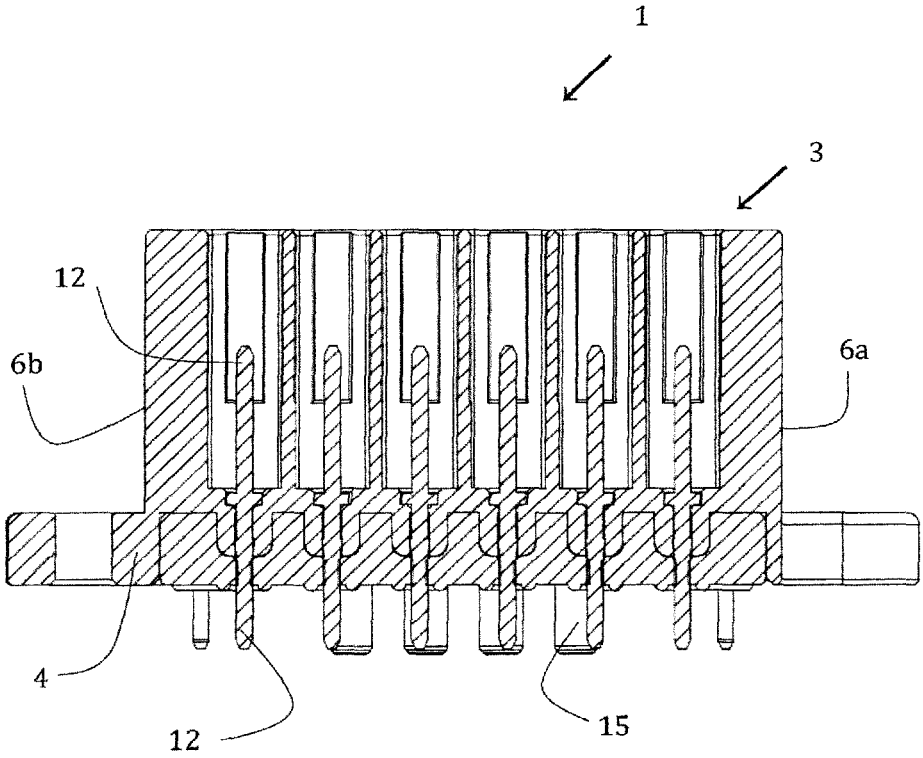
FIG. 5 is a cross-section view taken along line 5-5 in FIG. 3.
Figure 6:
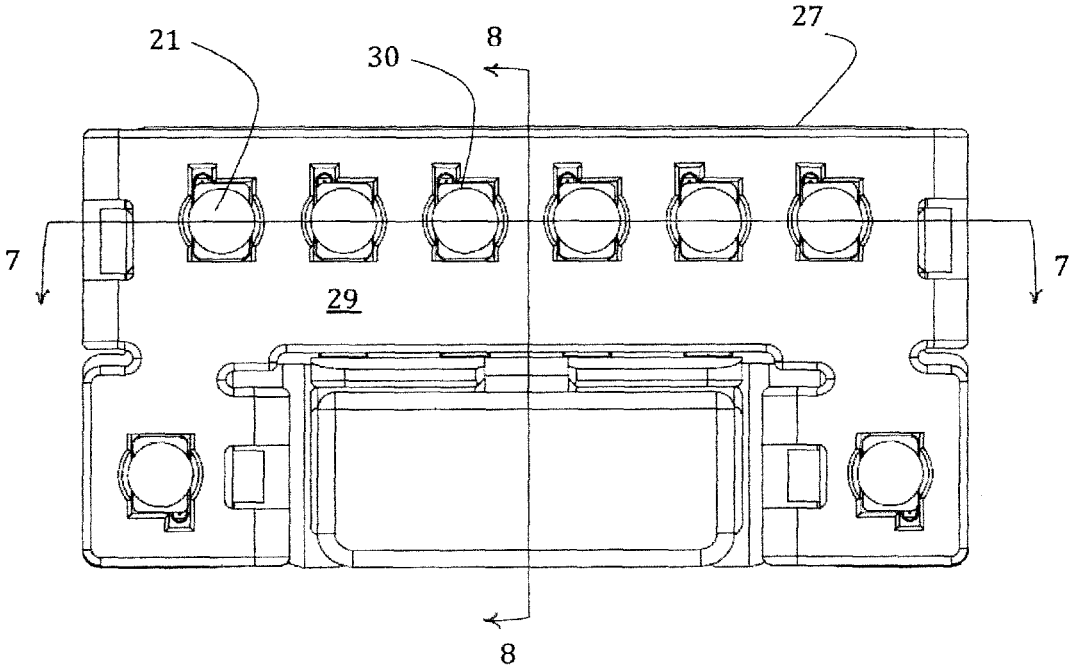
FIG. 6 is a view of a terminal position assurance cap of the electrical connector of the invention, installed on the female connector assembly of FIG. 2.

The arrangement of the socket contact 13, integral retention clip 23 and female connector assembly 2 of a second embodiment of the invention allows for a novel manner of removing a socket contact from the female connector assembly if replacement of the socket contact, or the like, is necessary. In order to remove the socket contact, the terminal position assurance cap is removed at least to the above-described pre-blocking stage, as shown in FIGS. 8A and 8C. Then, a servicing tool, as shown at 47 in FIG. 8C is inserted through a service opening 44 in tower element 18 and also through access opening 45 in the socket contact 13, until an end of the service tool contacts the integral retention clip 23. The integral retention clip 23 is then flexed away from the socket contact 13 by further inserting the servicing tool 47 until shelf 24 no longer interferes with the socket contact. The socket contact can then be removed by pulling the attached conducting wire upward until top portion 25 of the socket contact 13 is above the shelf 24, then removing the servicing tool and continuing to pull the attached conducting wire upward. It is to be understood that the pin contact must be removed from the socket contact prior to the above procedure, in order that the servicing tool can pass through the socket contact freely. Also, the socket contact must have an access opening as shown at 45 and each tower element must have a service opening as shown in FIG. 2A at 44.

Figure 10:
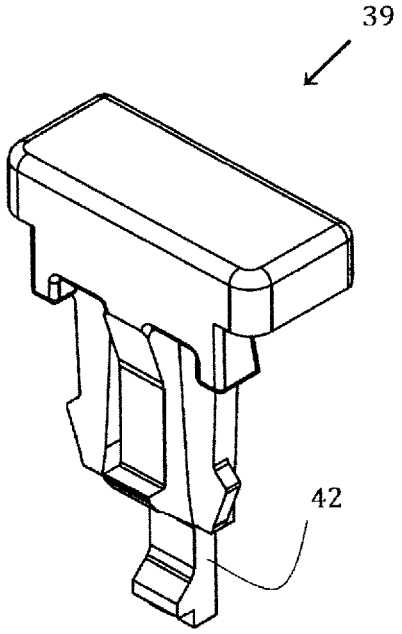
FIG. 10 is a perspective view of a connector position assurance component of the electrical connector of the invention.
Figure 11A:
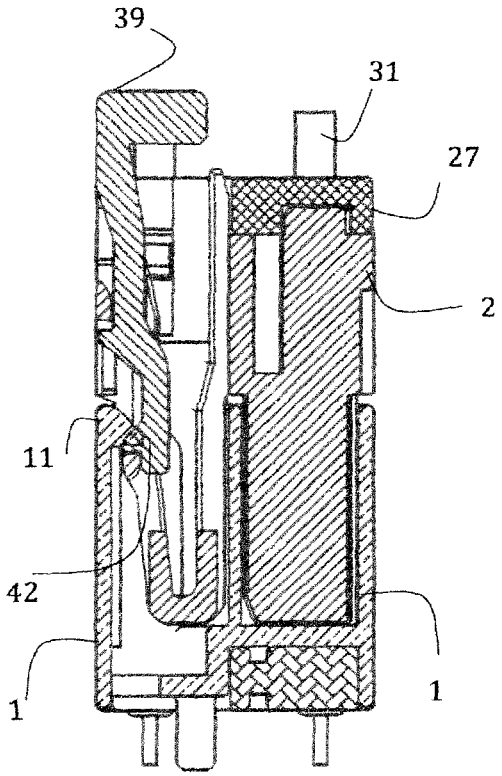
FIGS. 11A and 11B are cross section views of mated male and female connector assemblies taken at line 4-4 of FIG. 3 and line 8-8 of FIG. 6, respectively.
Figure 11B:
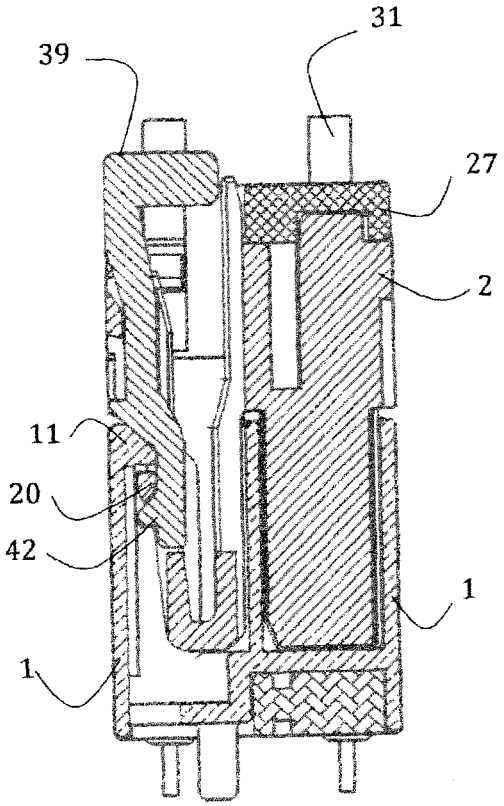

A secondary component of the electrical connector of the invention is a connector position assurance component 39. This component operates independently of the above-described terminal position assurance cap and it is not necessary for the operation of the terminal position assurance cap described above. A perspective view of the connector position assurance component is shown in FIG. 10. The connector position assurance component 39 assures that a third lock, consisting of third protrusion 11 on the male connector assembly and third latch 20 on the female connector assembly do not inadvertently become disengaged. FIG. 11A shows the male and female connector assemblies 1 and 2 fully mated, but the connector position assurance component 39 is not fully inserted. As shown in FIG. 11B, when the male and female connector assemblies 1 and 2 are fully mated, third latch 20 engages protrusion 11, and when connector position assurance component 39 is fully inserted into the header portion 19 of the female connector assembly 2, a finger 42 of the connector position assurance component is positioned against the latch 20 to prevent the latch from disengaging from protrusion 11.

As mentioned above, the present connector has an excellent circuit-to-circuit isolation distance. The connector has the feature that the current path between adjacent circuits, in relation to the connector mating distance of the male and female connector assemblies is maximized, when mated. The connector mating distance corresponds to a distance that the male and female connector assemblies must move, in relation to each other, to go from a state in which the insertion faces of each are initially contacting each other, to a state in which the male and female connectors are fully mated. The insertion face 3 of the male connector assembly 1 is shown in FIG. 1 and the insertion face 43 of the female connector assembly 2 corresponds to a face formed by ends of the tower elements 18 which are opposite to ends held by header 19. The insertion face of the female connector assembly is indicated at 43 in FIG. 7. Because of the configuration of the components of the electrical connector of this embodiment, the current path between adjacent circuits is at least twice the connector mating distance. The current path is such because the individual chambers 8*a* of the male connector assembly and the tower elements 18 of the female connector assembly extend the entire connector mating distance and there are no openings in the tower element walls or the individual chamber walls. Having the terminal position assurance cap located at the same end of the female connector assembly as the end at which the socket contacts are inserted enables this circuit-to-circuit isolation distance to be possible.

Figure 14:
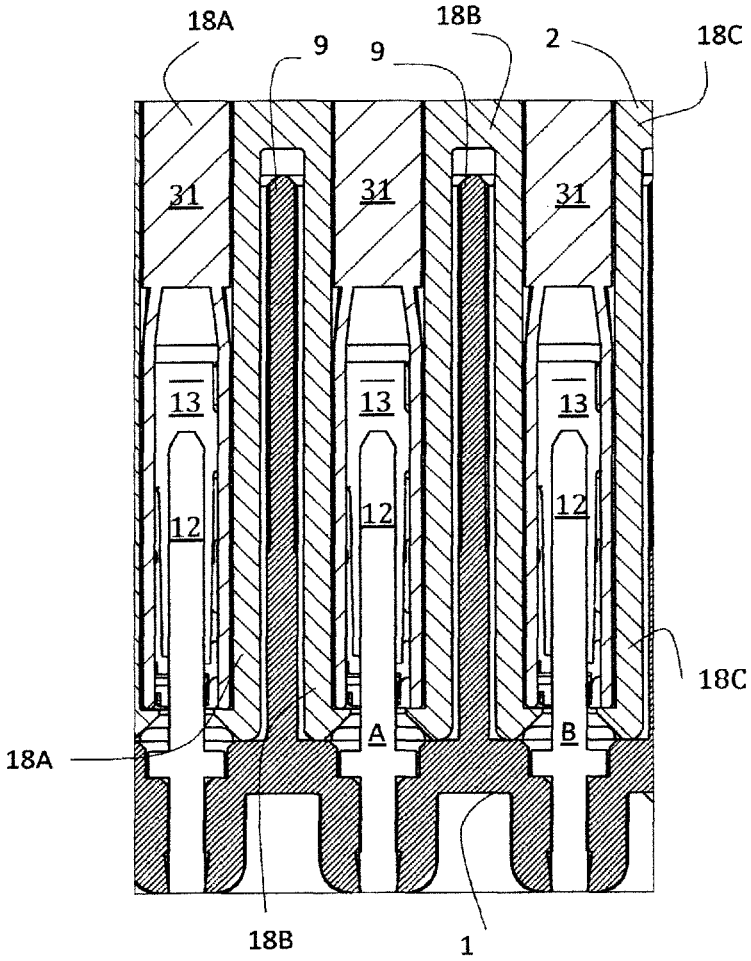
FIG. 14 is a cross section view of a portion of mated male and female connector assemblies taken at line 5-5 of FIG. 3 and line 7-7 of FIG. 6, respectively.

FIG. 14 shows a portion of male connector assembly 1 and female connector assembly 2 in the fully mated condition. Partitions 9 of the individual chambers of the male connector assembly are indicated and tower elements 18*a*, 18*b* and 18*c* of the female connector assembly are indicated. A current path from a pin or socket contact marked "A" to an adjacent pin or socket contact marked "B", for example, would be from "A" along the bottom of a first tower element 18*a*, up the gap between first tower element 18*a* and partition 9, across the top of partition 9, down the gap between second tower element 18*b*, and along the bottom of the second tower element 18*b* to "B". As can be seen in FIG. 14, there are no other openings or gaps available for a shorter current path. Although a current path as described above may be possible for connectors without a terminal position assuring device, the location of the present terminal position assurance cap enables the maximized circuit-to-circuit isolation distance to be possible.

In the embodiment having the socket contact removing feature, which requires a service opening in the tower element, the circuit-to-circuit isolation distance is reduced because of the openings in the tower elements which provides a possible shorter pathway between adjacent circuits.

The present invention is not limited to the above-described embodiments and various modifications in design, structural arrangement or the like may be used without departing from the scope or equivalents of the present invention.

The invention claimed is:

1. An electrical connector, comprising a male connector assembly of an insulating material for housing a plurality of pin contacts, each pin contact being disposed in an individual chamber having solid sidewalls and an opening at an insertion face thereof, and a female connector assembly of an insulating material for housing a plurality of socket contacts for mating with the pin contacts, each socket contact being disposed in a tower element having solid sidewalls and an opening at an insertion face thereof, a terminal position assurance cap for assuring a position of each housed socket contact in the female connector assembly, the terminal position assurance cap having fingers insertable into the female connector assembly from a socket contact insertion end arranged opposite the insertion face, wherein a circuit-to-circuit isolation distance of the electrical connector is at least twice a connector mating distance, when the male and female connector assemblies are mated to have the tower elements fully inserted in the individual chambers.

2. The electrical connector of claim 1, wherein each tower element includes a socket contact chamber for housing the socket contact and a finger chamber adjoining and communicating with the socket contact chamber, the socket contact chamber being configured to have the socket contact insertable through the socket contact insertion end of the female connector assembly.

3. The electrical connector of claim 2, wherein each finger chamber includes a flexible integral retention clip for retaining the socket contact therein, the flexible integral retention clip being attached to the female connector assembly at the insertion face end thereof, and the fingers of the terminal position assurance cap assures the retaining of the socket contact in the socket contact chamber, by blocking the flexible integral retention clip against the socket contact.

4. The electrical connector of claim 3, wherein the plurality of fingers of the terminal position assurance cap are disposed on a base, the base having openings for passing the socket contacts, and the fingers and openings correspond to the finger chambers and the socket contact chambers of the tower elements, respectively.

5. The electrical connector of claim 4, wherein the terminal position assurance cap and the female connector assembly include:

first locking means for holding the terminal position assurance cap at a partially inserted pre-blocking state for inserting the socket contacts into the socket contact chambers, and second locking means for holding the terminal position assurance cap at the fully inserted state.

6. The electrical connector of claim 1, wherein the male connector assembly and the female connector assembly include locking means for locking the same together.

7. The electrical connector of claim 6, wherein the male connector assembly includes a locking protrusion and the female connector assembly includes a flexible protrusion for bearing on the locking protrusion for locking the male connector assembly and the female connector assembly together when fully mated.

8. The electrical connector of claim 7, further comprising a connector position assurance component for insertion into the female connector assembly, wherein the connector position assurance component bears against the flexible protrusion to prevent flexing thereof.

9. An electrical connector, comprising a male connector assembly of an insulating material, for housing a plurality of pin contacts, each pin contact being disposed in an individual chamber having solid sidewalls and an opening at an insertion face thereof, and a female connector assembly of an insulating material, for housing a plurality of socket contacts for mating with the pin contacts, each socket contact being disposed in a tower element having an opening at an insertion face thereof, wherein each tower element includes in one sidewall a flexible integral retention clip for retaining the socket contact therein, and each tower element includes a service opening, in a sidewall opposing the flexible integral retention clip, the service opening for inserting a servicing tool to contact the flexible integral retention clip, to release the socket contact.

10. The electrical connector of claim 9, wherein each socket contact includes an access opening through which the servicing tool can access the flexible integral retention clip.

11. An electrical connector, comprising a male connector assembly of an insulating material for housing a plurality of pin contacts, each pin contact being disposed in an individual chamber having solid sidewalls and an opening at an insertion face thereof, and a female connector assembly of an insulating material for housing a plurality of socket contacts for mating with the pin contacts, each socket contact being disposed in a tower element having an opening at an insertion face thereof, wherein each tower element includes in one sidewall a flexible internal retention clip for retaining the socket contact therein, and each tower element includes a service opening, in a sidewall opposing the flexible integral retention clip, for inserting a servicing tool to contact the flexible integral retention clip, to release the socket contact; and a terminal position assurance cap for assuring a position of each housed socket contact in the female connector assembly, the terminal position assurance cap having fingers insertable into the female connector assembly from a socket contact insertion end arranged opposite the insertion face.

12. A method for removing a socket contact from a female connector assembly, comprising providing a female connector assembly of an insulating material, for housing a plurality of socket contacts for mating with a pin contact of a male connector assembly, each socket contact being disposed in a tower element, each tower element including a socket contact chamber for housing the socket contact and a finger chamber adjoining and communicating with the socket contact chamber, each finger chamber of each tower element including in one sidewall a flexible integral retention clip for retaining the socket contact therein, and each tower element including a service opening, in a sidewall opposing the flexible integral retention clip; and inserting a servicing tool through the service opening to contact and flex the flexible integral retention clip to release the socket contact.

* * * * *